US009439460B2

(12) United States Patent
Richards

(10) Patent No.: US 9,439,460 B2
(45) Date of Patent: Sep. 13, 2016

(54) INFLATABLE PROTECTION SAFETY APPARATUS AND METHOD OF USE

(71) Applicant: S.S. Richards & Associates, LLC, Austin, TX (US)

(72) Inventor: Scott S. Richards, Austin, TX (US)

( * ) Notice: Subject to any disclaimer, the term of this patent is extended or adjusted under 35 U.S.C. 154(b) by 93 days.

(21) Appl. No.: 13/968,219

(22) Filed: Aug. 15, 2013

(65) Prior Publication Data

US 2014/0047624 A1 Feb. 20, 2014

Related U.S. Application Data

(60) Provisional application No. 61/683,485, filed on Aug. 15, 2012.

(51) Int. Cl.

| | |
|---|---|
| ***A41D 13/015*** | (2006.01) |
| ***A62B 17/00*** | (2006.01) |
| ***F41H 1/00*** | (2006.01) |
| ***G21F 3/02*** | (2006.01) |
| ***A41D 13/018*** | (2006.01) |
| ***A62B 35/00*** | (2006.01) |
| ***A41D 13/00*** | (2006.01) |

(52) U.S. Cl.

CPC ..... *A41D 13/018* (2013.01); *A41D 13/0007* (2013.01); *A41D 13/0155* (2013.01); *A62B 35/00* (2013.01)

(58) Field of Classification Search

CPC ..... A41D 13/015; A41D 13/0155; A41D 13/018; A62B 99/00; A62B 35/00; A62B 35/005; A62B 35/0018; A62B 5/1117; A62B 5/1116; A62B 5/6804; A62B 5/6802; A62B 5/6805; A42B 3/0486

USPC ..... 2/DIG. 3, DIG. 10, 92, 102, 413, 455, 2/462, 463, 465, 467, 468, 456; 280/730.1; 441/92

See application file for complete search history.

(56) References Cited

U.S. PATENT DOCUMENTS 3,717,143 A * 2/1973 Johnson ..... 602/19
3,895,396 A * 7/1975 Amarantos ..... 2/458

(Continued)

FOREIGN PATENT DOCUMENTS

DE 10316766 A1 * 10/2004 ..... A41D 13/015
FR 2748941 A1 * 11/1997
GB 2312369 A * 10/1997 ..... A41F 9/00

*Primary Examiner* — Alissa L Hoey
*Assistant Examiner* — Jameson Collier
(74) *Attorney, Agent, or Firm* — Hulsey Hunt & Parks, P.C.; William N. Hulsey, III; Jeffrey D. Hunt

(57) ABSTRACT

An inflatable personal protection apparatus for preventing or substantially reducing injury to a wearer of the apparatus from a hazard, the personal protection apparatus includes a wearable support structure associated with an inflatable apparatus, the inflatable apparatus includes a bladder including a low-elasticity flexible material expanding to the substantially fixed volume, the bladder configured to receive a volume of pressurized gas, an inflator connected to the bladder configured to inflate the bladder with a volume of pressurized gas, and an activation mechanism system sensing ambient conditions, and in response to an ambient condition exceeding a predetermined threshold for a predetermined period of time, the activation mechanism system activates the inflator to generate a volume of pressurized gas into the bladder, the bladder expanding to the substantially fixed volume of the bladder.

23 Claims, 10 Drawing Sheets

(56) References Cited

U.S. PATENT DOCUMENTS

| | | | | | |
|---|---|---|---|---|---|
| 3,921,944 | A * | 11/1975 | Morrison | A62B 1/22 | 2/456 |
| 4,089,065 | A * | 5/1978 | McGee | 2/456 |
| 4,943,252 | A * | 7/1990 | Manix | 441/87 |
| 5,034,998 | A * | 7/1991 | Kolsky | 2/465 |
| 5,397,171 | A * | 3/1995 | Leach | 297/484 |
| 5,500,952 | A * | 3/1996 | Keyes | 2/465 |
| 5,781,936 | A * | 7/1998 | Alaloof | 2/456 |
| 5,937,443 | A * | 8/1999 | Kageyama et al. | 2/69 |
| 6,270,386 | B1 * | 8/2001 | Visocekas | 441/80 |
| 6,433,691 | B1 * | 8/2002 | Hilliard et al. | 340/573.1 |
| 6,543,054 | B2 * | 4/2003 | Gabriel | 2/1 |
| 6,920,647 | B2 * | 7/2005 | Ulert et al. | 2/465 |
| 6,923,779 | B1 * | 8/2005 | Choiniere | 602/19 |
| 7,017,195 | B2 * | 3/2006 | Buckman et al. | 2/455 |
| 7,150,048 | B2 * | 12/2006 | Buckman | 2/465 |
| 7,343,632 | B2 * | 3/2008 | Neron | 2/456 |
| 7,774,867 | B2 * | 8/2010 | Orita et al. | 2/456 |
| 7,921,472 | B2 * | 4/2011 | Mazzarolo | 2/108 |
| 2001/0049840 | A1 * | 12/2001 | Atanasio | 2/456 |
| 2004/0003455 | A1 * | 1/2004 | Davidson | 2/455 |
| 2004/0033739 | A1 * | 2/2004 | Courtney | 441/88 |
| 2005/0279559 | A1 * | 12/2005 | Thevenot | 180/271 |
| 2009/0019623 | A1 * | 1/2009 | Uchida et al. | 2/455 |
| 2010/0120306 | A1 * | 5/2010 | Malcom | B63C 9/08 441/92 |
| 2011/0047684 | A1 * | 3/2011 | Jan et al. | 2/455 |
| 2013/0127140 | A1 * | 5/2013 | Obadia | 280/733 |
| 2014/0047623 | A1 * | 2/2014 | Richards | 2/455 |
| 2014/0123374 | A1 * | 5/2014 | Gelston et al. | 2/455 |

* cited by examiner

INFLATABLE PROTECTION SAFETY APPARATUS AND METHOD OF USE

CLAIM OF PRIORITY

The present nonprovisional application claims priority from U.S. Provisional Patent Application Ser. No. 61/683,485 filed Aug. 15, 2012 which is incorporated herein by reference thereto.

FIELD OF THE INVENTION

The invention relates to protection safety systems.

BACKGROUND OF THE INVENTION

According to the United States Department of Labor's Occupational Safety and Health Administration (OSHA), an estimated 2.3 million construction workers, or 65 percent of the construction industry, work on scaffolds. Additionally, many jobs include elevated worksites other than scaffolds. Protecting these workers from elevated work site-related accidents may prevent some of the 4,500 injuries and over 60 deaths every year in the United States.

For this reason, Title 29 of the Code of Federal Regulations requires fall arrest systems for workers that work on scaffolding or at certain heights. Fall arrest systems are meant to aid in safely stopping a person that is already falling and can come in the form of general fall arrest or personal fall arrest. Fall arrest does not necessarily translate into fall protection.

Several different fall arrest systems exist, such as railings, safety nets and various forms of lifelines, for example, a full body harness and lanyard.

When someone attached to one of these lifelines falls, the lifeline stops the person at a certain distance. This distance can be controlled by the length of the lanyard to prevent the person from hitting the ground. Lifelines require an anchor, and/or an extensive array of overhead safety wires to provide for the attachment of full body harness lanyards above a work site, and workers have to work around the lanyard as they move. By its intrinsic nature, the full body harness with lanyard actually applies a horizontal component to the restraining force in most circumstances, which pulls the worker toward pipes or structure as it arrests his fall. Additionally the lanyard must extend about six feet in arresting the workers fall, allowing his torso and head to pass between the pipes or structural elements that he is working on as his fall is arrested, so often times a worker that is saved by the fall arrest system will still suffer injuries, particularly head injuries, as a result of hitting obstacles during the fall. Some of these injuries may be fatal. While effectively arresting the fall, this type of fall arrest system does not provide effective fall protection.

The lanyard system also requires retracing steps, back to the overhead attachment point, and reattachment to the next overhead lanyard attachment point.

In addition, the elderly and similar persons are prone to slips, stumbles or falls while walking; or those for whom such a spill is likely to cause serious injury, like head injuries, broken bones, cuts, bruises or contusions.

In addition, firefighers are caught in a backdraft, where conditions provide fresh oxygen to a fire causing it to explode back at fire fighter in a flash or other swiftly developing situations that a fire fighter would not be able to react to in time.

In addition, H2S kills workers in oil producing wells and producing facilities.

In addition, asbestos is a carcinogen that infects unsuspecting victims who are unaware of this hazard.

The approaches described in this section could be pursued, but are not necessarily approaches that have been previously conceived or pursued. Therefore, unless otherwise indicated herein, the approaches described in this section are not prior art to the claims in this application and are not admitted to be prior art by inclusion in this section.

BRIEF SUMMARY OF THE INVENTION

The disclosed subject matter relates to personal protection safety systems that uses an inflatable apparatus system, to prevent injuries in a wide variety of circumstances and settings. How the device is worn, the trigger mechanism, how it deploys and the size and shape of the inflatable apparatus vary in different embodiments. The inflatable apparatus can be inflated by any inflation apparatus, for example, a pressurized gas canister, which may be triggered by a sensor sensing ambient conditions that is tailored to the application. The trigger mechanism may be oriented by gravity to prevent unintended deployment of any of the various inflatable apparatus protection devices. In response to a hazard, the personal protection system reacts to protect the individual faster than human reaction time.

In some embodiments, the personal protection apparatus for preventing or substantially reducing injury to a wearer of said apparatus from a hazard, the personal protection apparatus comprises:

- a wearable support structure associated with an inflatable apparatus, said inflatable apparatus comprising:
  - a bladder comprising a low-elasticity flexible material expands to said substantially fixed volume, said bladder configured to receive a volume of pressurized gas,
  - an inflator connected to said bladder configured to inflate said bladder with a volume of pressurized gas, and
  - an activation mechanism system sensing ambient conditions, and in response to an ambient condition exceeding a predetermined threshold for a predetermined period of time, said activation mechanism system activates said inflator to generate a volume of pressurized gas into said bladder, said bladder expanding to said substantially fixed volume of said bladder.

In some embodiments, the activation mechanism system comprises:

- a sensor sensing said ambient conditions,
- an electrical connection to said inflator configured to activate said inflator in response to an ambient condition exceeding a predetermined threshold for a predetermined period of time,
- a transponder for communicating the position of said inflatable apparatus, and
- an independent and portable power source configured to provide power to said activation mechanism system.

In some embodiments, the ambient condition is one or more of the following: acceleration, radiation, temperature, gas concentration, and particulate concentration in air.

In some embodiments, the personal protection apparatus for preventing or substantially reducing injury to a wearer of said apparatus experiencing a fall or similar event, the personal protection apparatus comprises:

a wearable support structure associated with an inflatable apparatus, said inflatable apparatus comprising:

a bladder comprising a low-elasticity flexible material inflatable to a substantially fixed volume, said bladder configured to receive a volume of pressurized gas, an inflator connected to said bladder configured to inflate said bladder with a volume of pressurized gas, and an activation mechanism system sensing accelerations and in response to a vertically downward component of acceleration exceeding a predetermined threshold for a predetermined period of time, said activation mechanism system activates said inflator to generate a volume of pressurized gas into said bladder, said bladder expanding to said substantially fixed volume of said bladder.

In some embodiments, the activation mechanism system comprises:

a directional accelerometer sensing accelerations;

an electrical connection to said inflator configured to activate sad inflator in response to a vertically downward component of acceleration exceeding a predetermined threshold for a predetermined period of time;

a transponder for communicating the position of said inflatable apparatus; and an independent and portable power source for providing power to the activation mechanism system.

In some embodiments, the inflatable apparatus comprises a plurality of bladders, said activation mechanism system initiating an inflation sequence activating each said inflator to generate a volume of pressurized gas into said plurality of bladders in a specific and timed progression.

In some embodiments, the pressurized gas is sealed inside of said inner bladder after inflation.

In some embodiments, the inflatable apparatus, initially uninflated and in either a rolled or folded condition, and in response to a vertically downward component of acceleration exceeding a predetermined threshold for a predetermined period of time, said activation mechanism system activates said inflator to generate a volume of pressurized gas into said bladder, thereby inflating said inflatable apparatus to an inflated and either unrolled or unfolded condition.

In some embodiments, a cosmetic, breakaway outer layer covers said bladder in its initial uninflated and either rolled or folded condition.

In some embodiments, the bladder seals in the pressurized gas after inflation.

In some embodiments, the inflatable apparatus, initially uninflated and in either a rolled or folded condition, said wearable support structure and said associated inflatable apparatus is contoured and arranged to provide the wearer with unobstructed freedom of movement, said wearable support structure further comprising an elastic portion and a plurality of back support staves providing lumbar back support to minimize back fatigue for the wearer.

In some embodiments, the inflator is one or more of the following:

a compressed gas inflator;

an inflator comprising a cartridge filled with a plurality of compounds, when mixed, said plurality of compounds generates gas; or a solid-propellant inflator.

In some embodiments, the inflator generates sufficient inflation gas in under 200 milliseconds.

In some embodiments, the personal protection apparatus for preventing or substantially reducing injury to a wearer of said apparatus experiencing a fall or similar event, the personal protection apparatus comprises:

a wearable support structure associated with an inflatable apparatus, said inflatable apparatus comprising:

an upper bladder, inflatable to a substantially fixed volume, associated with a top portion of said wearable support structure, said upper bladder in the inflated condition encircling the wearer, with two ends of said inflated upper bladder overlapping, with a midpoint defined as halfway between said two ends, which is on the opposite side of said upper bladder from the overlap of said two ends, said upper bladder comprising a low-elasticity flexible material for receiving a volume of pressurized gas, when inflated, said upper bladder subdivided into at least four vertically oriented, interconnected chambers equally distributed over the horizontal extent of said upper bladder, a lower bladder, inflatable to a substantially fixed volume, associated with a bottom portion of said wearable support structure, said lower bladder in the inflated condition encircling the wearer, with two ends of said lower bladder overlapping, with a midpoint defined as halfway between said two ends, which is on the opposite side of said lower bladder from the overlap of said two ends, said lower bladder comprising a low-elasticity flexible material for receiving a volume of pressurized gas, when inflated, said lower bladder subdivided into at least four vertically oriented, interconnected chambers equally distributed over the horizontal extent of said lower bladder, an inflator connected to each of said upper and lower bladders configured to inflate the vertically oriented, interconnected chambers of said upper and lower bladders with a volume of pressurized gas, an activation mechanism system for sensing accelerations and in response to a vertically downward component of acceleration exceeding a predetermined threshold for a predetermined period of time, said activation mechanism system initiates an inflation sequence activating said inflators to generate a volume of pressurized gas into each of said upper and lower bladders, said bladders expanding to said substantially fixed volume, wherein said inflation sequence progresses from an area surrounding said midpoint towards said two ends in a specific, timed progression, completing said inflation sequence in less than 500 milliseconds.

In some embodiments, the activation mechanism system comprises:

a directional accelerometer sensing accelerations;

an electrical connection to said inflator configured to activate said inflator in response to a vertically downward component of acceleration exceeding a predetermined threshold for a predetermined period of time;

a transponder for communicating the position of said inflatable apparatus; and an independent and portable power source for providing power to the activation mechanism system.

In some embodiments, the predetermined threshold is a vertically downward component of acceleration of at least 16 ft/sec$^2$ for a predetermined period of time of at least 100 milliseconds, wherein said inflation of the vertically oriented, interconnected chambers is designed to move the wearer's limbs ergonomically forward as the inflation sequence progresses from an area surrounding said midpoint towards said two ends in a specific, timed progression, completing said inflation sequence in less than 500 milliseconds.

In some embodiments, the inflatable apparatus, initially uninflated and in either a rolled or folded condition, and in response to a vertically downward component of acceleration exceeding a predetermined threshold for a predetermined period of time, said activation mechanism system initiates an inflation sequence activating said inflators to generate a volume of pressurized gas into each of said upper and lower bladders, said bladders expanding to said substantially fixed volume, thereby inflating said inflatable apparatus to an inflated and either unrolled or unfolded condition.

In some embodiments, a cosmetic, breakaway outer layer covers said upper and lower bladders in its initial uninflated and either rolled or folded condition.

In some embodiments, the upper and lower bladders expands to said substantially fixed volume, at which point increased pressure does not substantially increase said substantially fixed volumes of said upper and lower bladders until a yield point of said low-elasticity flexible material is reached.

In some embodiments, the inflatable apparatus, initially uninflated and in either a rolled or folded condition, said wearable support structure is contoured and arranged to provide the wearer with unobstructed freedom of movement, said wearable support structure further comprises an elastic portion and a plurality of back support staves providing lumbar back support to minimize back fatigue for the wearer.

In some embodiments, the wearable support structure is further associated with a fall arrest harness and said predetermined threshold is a vertically downward component of acceleration of 30 ft/sec$^2$ for a predetermined period of time of at least 250 milliseconds, wherein said inflation of the vertically oriented, interconnected chambers is designed to move the wearer's limbs ergonomically forward as the inflation sequence progresses from an area surrounding said midpoint towards said two ends in a specific, timed progression, completing said inflation sequence in less than 500 milliseconds.

In some embodiments, the inflatable apparatus, initially uninflated and in either a rolled or folded condition, and in response to a vertically downward component of acceleration exceeding a predetermined threshold for a predetermined period of time, said activation mechanism system initiates an inflation sequence activating said inflators to generate a volume of pressurized gas into each of said upper and lower bladders, said bladders expanding to said substantially fixed volume, thereby inflating said inflatable apparatus to an inflated and either unrolled or unfolded condition.

In some embodiments, the upper and lower bladders expands to said substantially fixed volume, at which point increased pressure does not substantially increase said substantially fixed volumes of said upper and lower bladders until a yield point of said low-elasticity flexible material is reached.

In some embodiments, the inflatable apparatus, initially uninflated and in either a rolled or folded condition, said wearable support structure is contoured and arranged to provide the wearer with unobstructed freedom of movement, said wearable support structure further comprising an elastic portion, a plurality of back support staves providing lumbar back support to minimize back fatigue for the wearer, and elastic shoulder straps or crotch straps to secure said wearable support structure.

In some embodiments, the low-elasticity flexible material of said upper and lower bladders is puncture-resistant.

In some embodiments, the personal protection apparatus for preventing or substantially reducing injury to a wearer of said apparatus from a fire or similar event, the personal protection apparatus comprises:

- a wearable support structure associated with an inflatable apparatus, said inflatable apparatus comprising:
  - a bladder comprising a low-elasticity flexible material expands to said substantially fixed volume, said bladder configured to receive a volume of pressurized gas,
  - an inflator connected to said bladder configured to inflate said bladder with a volume of pressurized gas, and
  - an activation mechanism system sensing radiation or temperature, and in response to an ambient condition exceeding a predetermined threshold for a predetermined period of time, said activation mechanism system activates said inflator to generate a volume of pressurized gas into said bladder, said bladder expanding to said substantially fixed volume of said bladder.

In some embodiments, the material of the bladder has one or more of the following properties: fire resistance, radiation blocking, radiation reflection, transparency, or puncture resistance.

These and other aspects of the disclosed subject matter, as well as additional novel features, will be apparent from the description provided herein. The intent of this summary is not to be a comprehensive description of the subject matter, but rather to provide a short overview of some of the subject matter's functionality. Other systems, methods, features and advantages here provided will become apparent to one with skill in the art upon examination of the following FIGURES and detailed description. It is intended that all such additional systems, methods, features and advantages that are included within this description, be within the scope of any claims filed later.

BRIEF DESCRIPTIONS OF THE DRAWINGS

The novel features believed characteristic of the disclosed subject matter will be set forth in any claims that are filed later. The disclosed subject matter itself, however, as well as a preferred mode of use, further objectives, and advantages thereof, will best be understood by reference to the following detailed description of an illustrative embodiment when read in conjunction with the accompanying drawings, wherein:

In the FIGURES, like elements should be understood to represent like elements, even though reference labels are omitted on some instances of a repeated element, for simplicity.

DETAILED DESCRIPTION OF ILLUSTRATIVE EMBODIMENTS

Reference now should be made to the drawings, in which the same reference numbers are used throughout the different figures to designate the same components.

Figure 1:
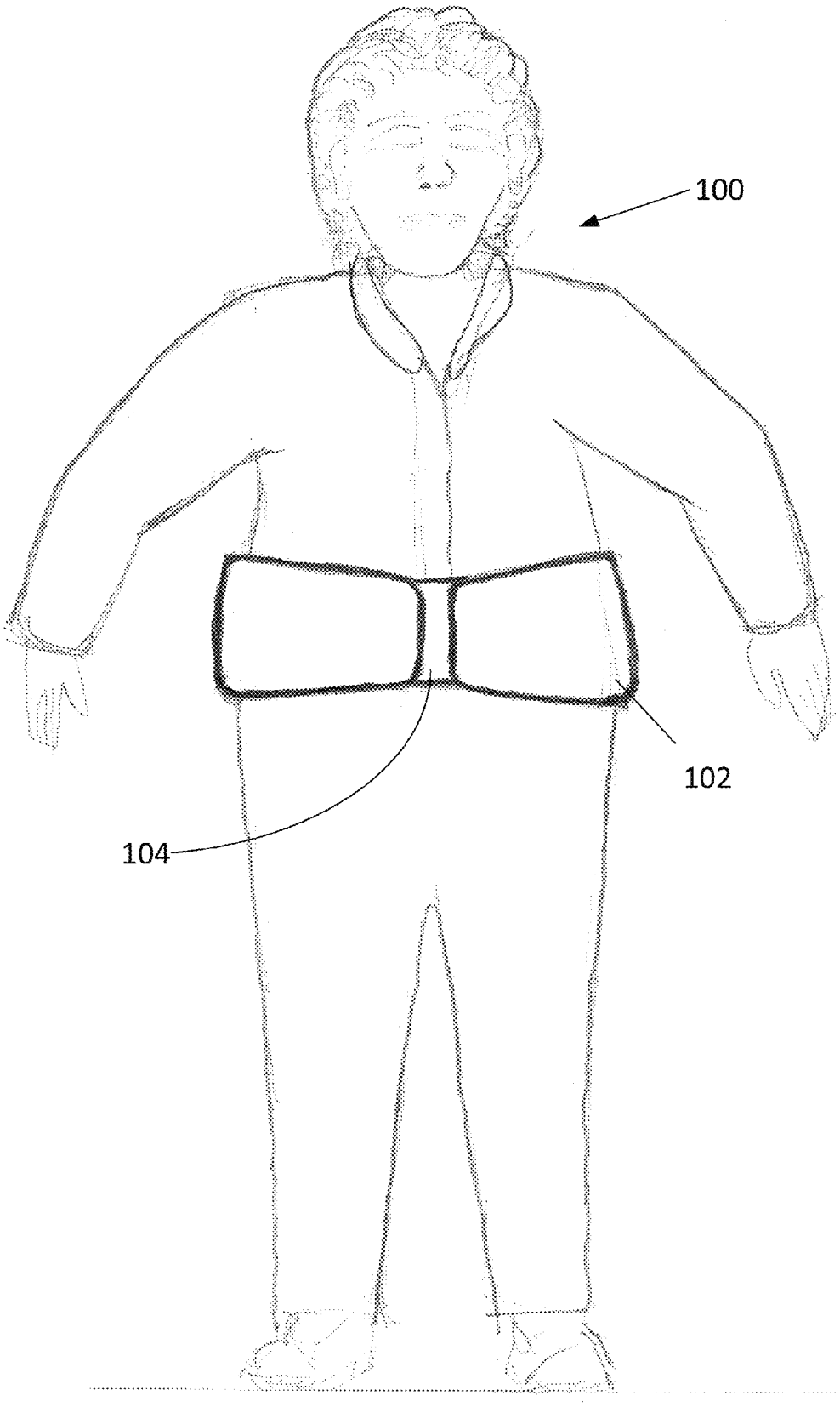
FIG. 1 depicts a view of an ambulatory fall protection embodiment of the protection safety apparatus in the uninflated condition.

FIG. 1 shows a wearer 100 wearing a personal protection apparatus 102 associated with a wearable support structure 104.

Figure 2:
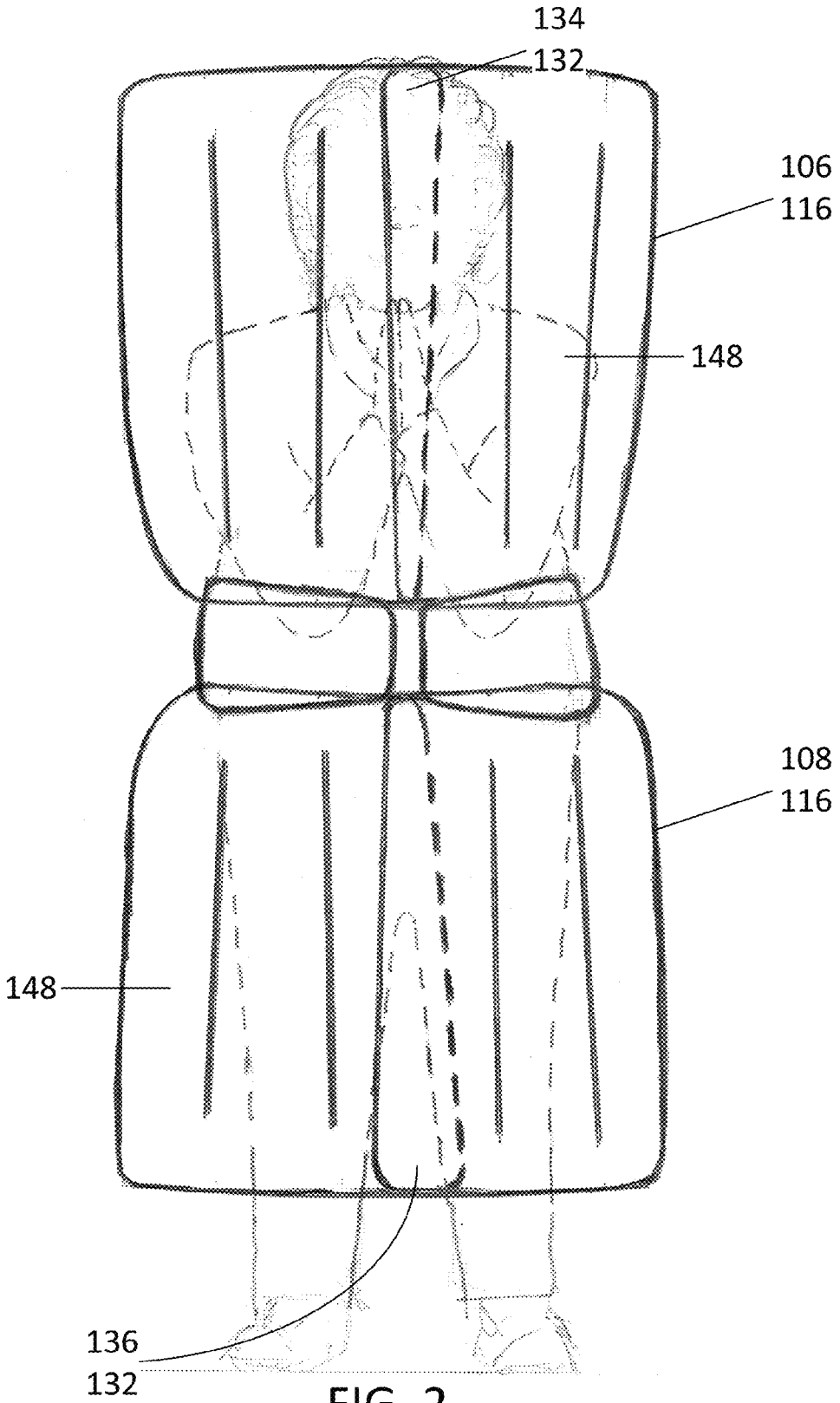
FIG. 2 depicts a view of an ambulatory fall protection embodiment of the protection safety apparatus in the inflated condition.

FIG. 2 shows one embodiment, when the personal protection apparatus 102 senses a vertically downward component of acceleration exceeding a predetermined threshold, the personal protection apparatus 102 inflates to an inflated condition. The upper bladder 106 comprises a low-elasticity flexible material 116. A low-elasticity flexible material 116 may be Dacron, ballistic nylon, Kevlar, or another low-elasticity flexible material. The lower bladder 108 comprises a low-elasticity flexible material 116. A low-elasticity flexible material 116 may be Dacron, ballistic nylon, Kevlar, or another low-elasticity flexible material. The two ends 134 of the upper bladder form a discontinuous gap 132 and the two ends 136 of the upper bladder form also from a discontinuous gap 132. The upper bladders 106 and lower bladders 108 are comprised of interconnected chambers 148.

Figure 3:
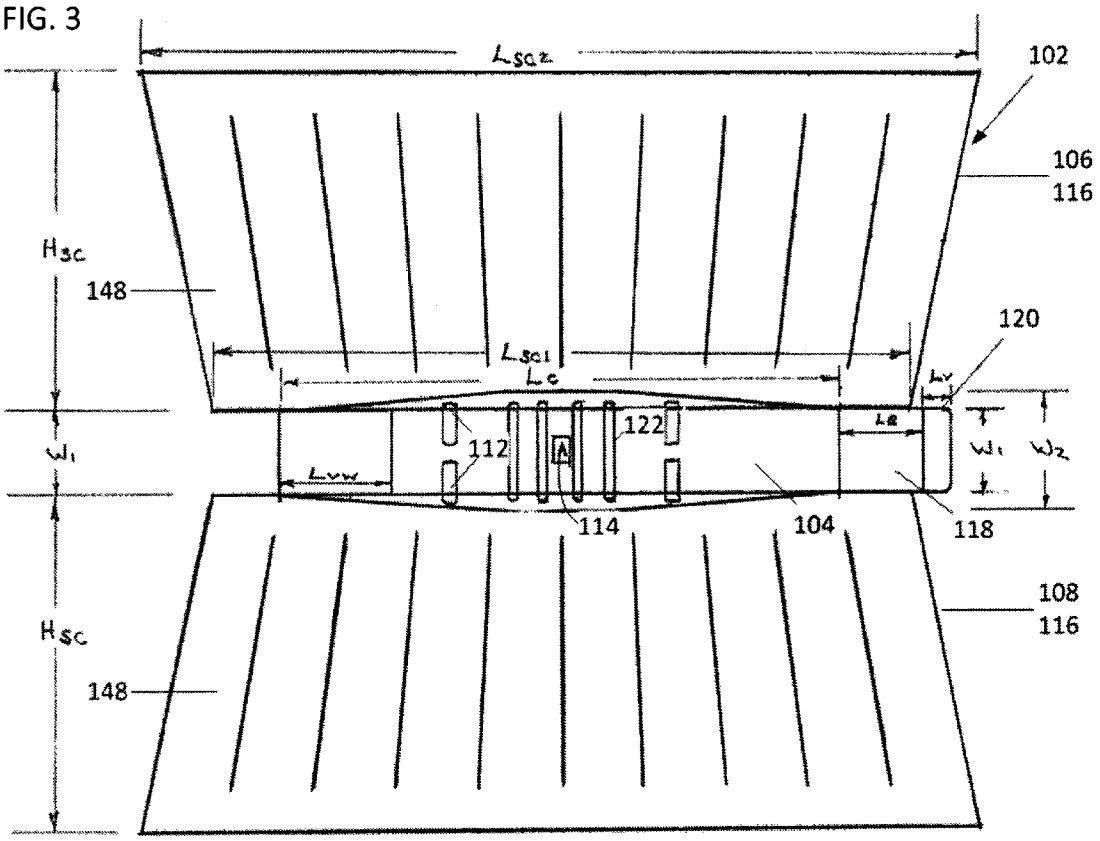
FIG. 3 depicts a configuration of the ambulatory fall protection inflatable apparatus and associated wearable support structure and arrangement of its components.

FIG. 3 shows one embodiment of personal protection apparatus 102 with its upper bladder 106 and lower bladder 108. The personal protection apparatus 102 is associated with a wearable support structure 104 with a Velcro closer 120 and an elastic portion of the wearable support structure 118 and a plurality of back support staves 122. An activation mechanism system 114 senses accelerations and in response to a vertically downward component of acceleration exceeding a predetermined threshold for a predetermined period of time, the activation mechanism system 114 activates the inflators 112 to generate a volume of pressurized gas into the upper bladder 106 and lower bladder 108.

Figure 4:
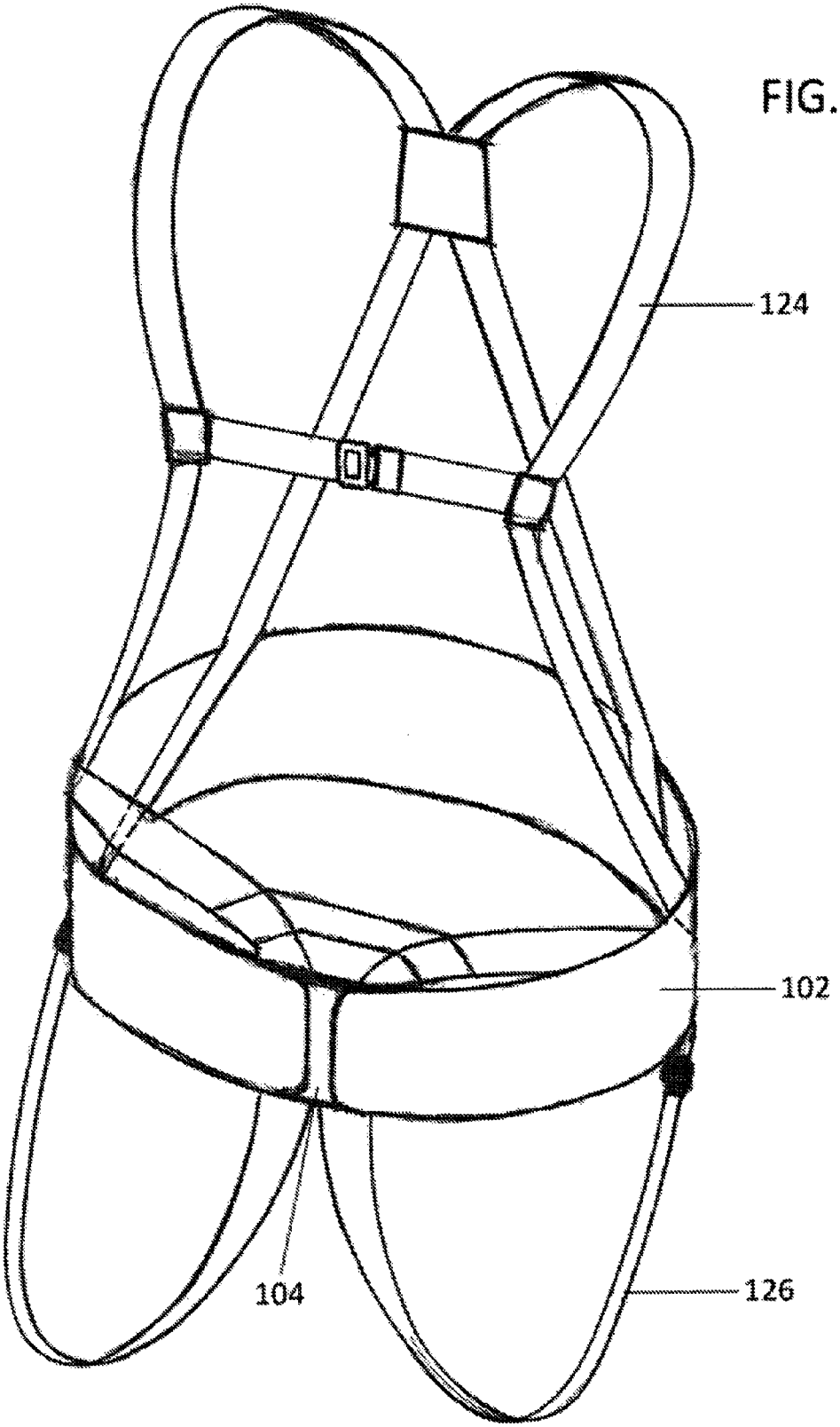
FIG. 4 depicts a perspective view of an industrial fall protection apparatus.

FIG. 4 shows one embodiment of the personal protection apparatus 102, may be associated with a wearable support structure 104. The personal protection apparatus 102 may further comprise shoulder straps 124 and/or leg straps 126.

Figure 5:
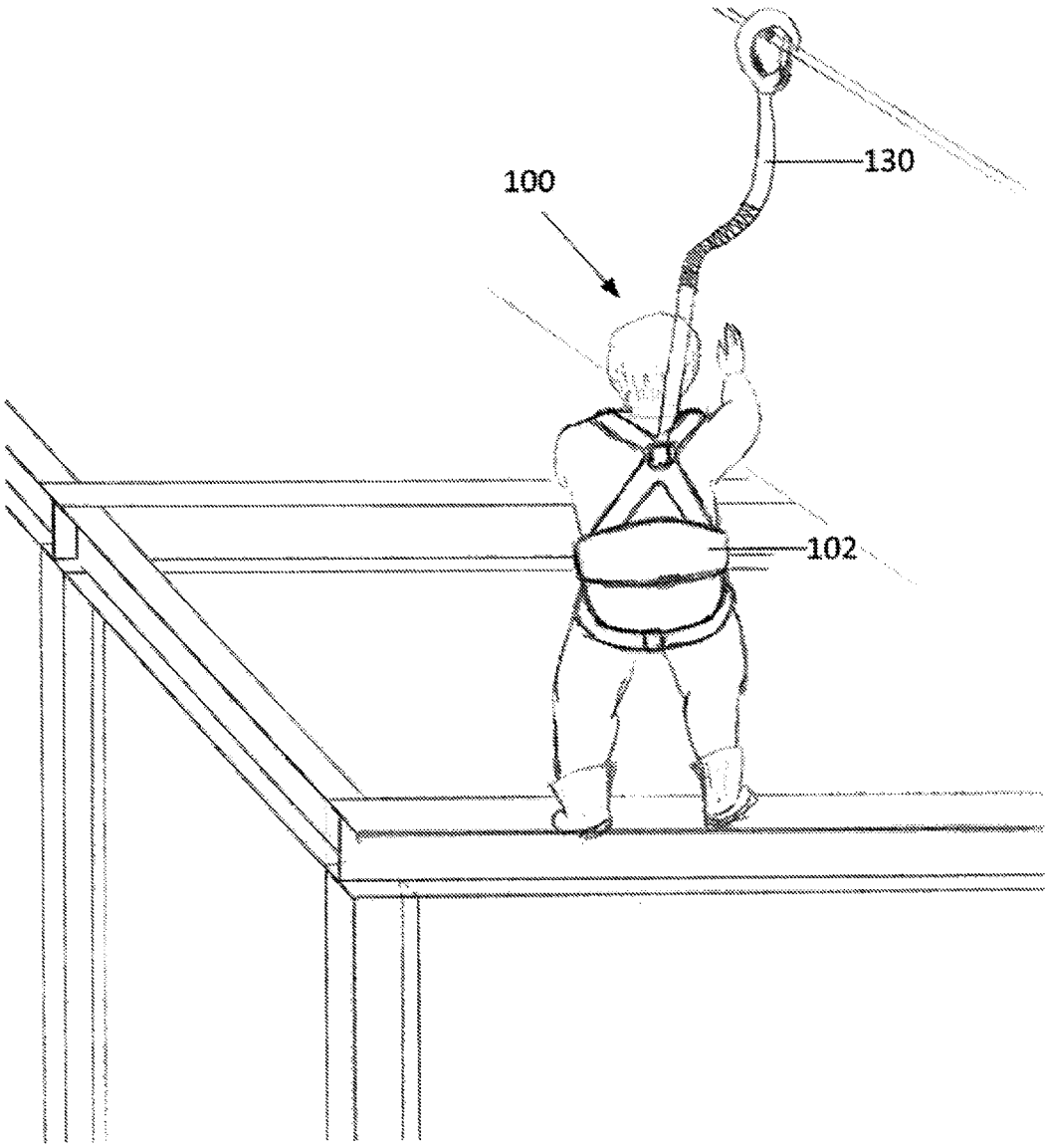
FIG. 5 depicts an illustration of a worker wearing the fall protection apparatus in the uninflated condition.

FIG. 5 shows a wearer 100 on an elevated structure wearing the personal protection system 102 attached to safety line by associated lanyard 130. The personal protection system 102 may be attached to the shoulder straps 124 in the uninflated condition.

Figure 6:
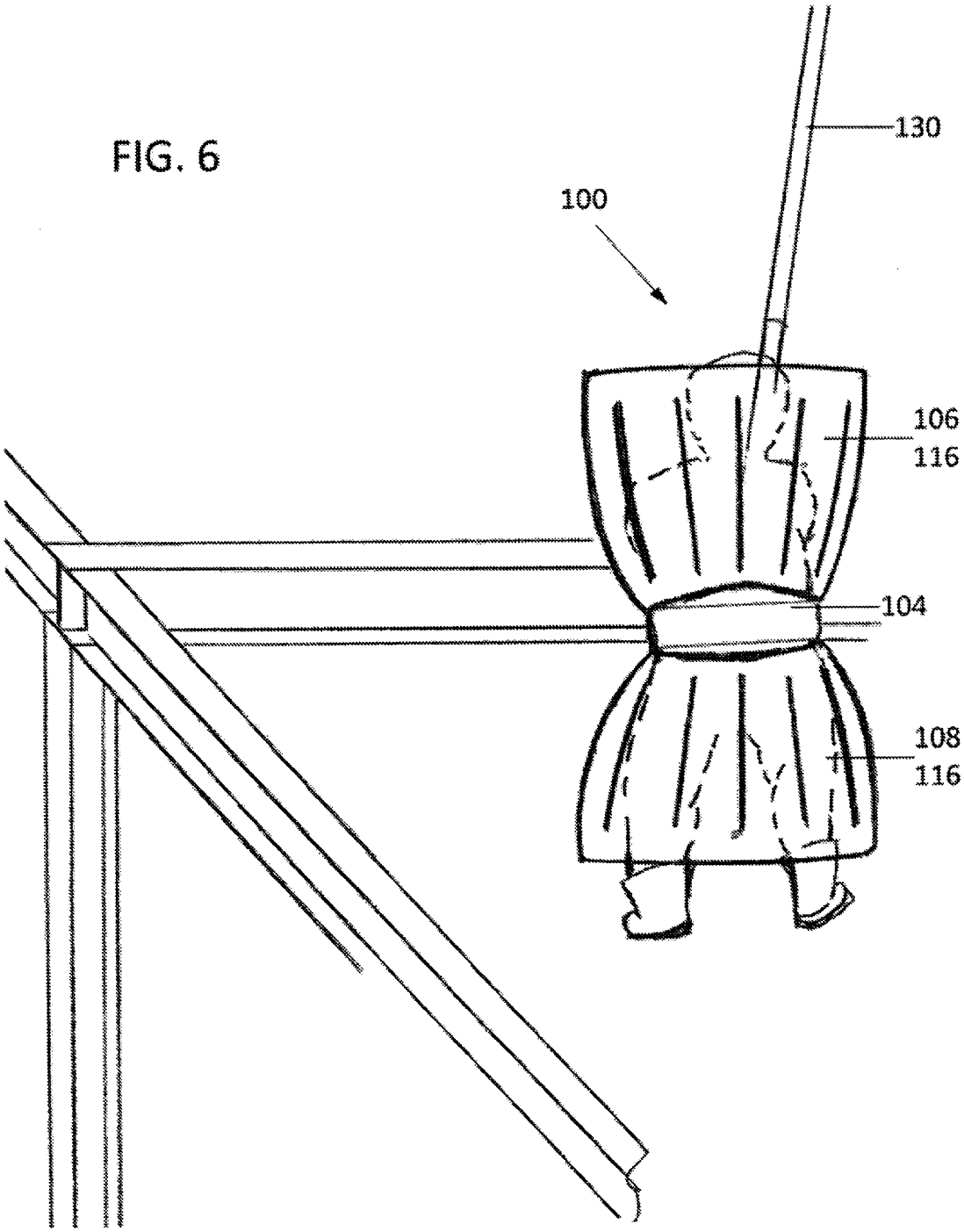
FIG. 6 depicts the fall protection apparatus in the inflated condition arresting a fall and protecting the worker.

FIG. 6 shows a wearer 100 after a fall with lanyard 130 arresting the fall. The wearer 100 is protected from injury by the personal protection system 102 in the inflated condition by upper bladder 106 and lower bladder 108.

Figure 7:
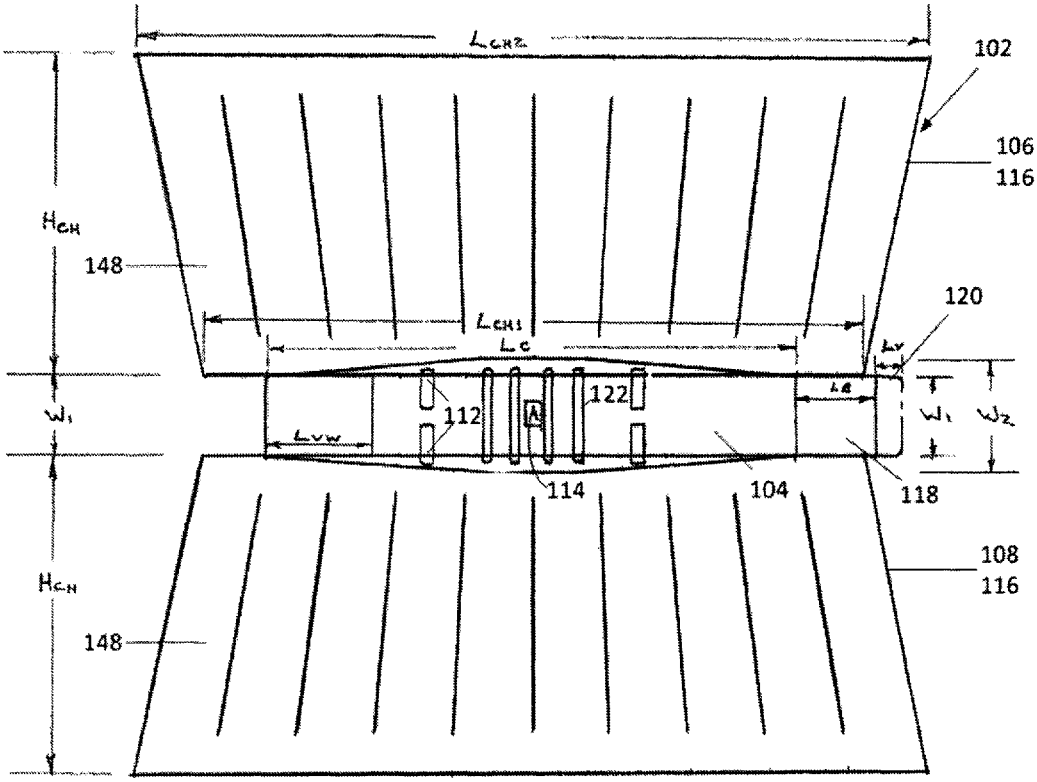
FIG. 7 depicts a configuration of the industrial fall protection inflatable apparatus and associated wearable support structure and arrangement of its components.

FIG. 7 shows one embodiment of personal protection apparatus 102 with its upper bladder 106 and lower bladder 108. The personal protection apparatus 102 is associated with a wearable support structure 104 with a Velcro closer 120 and an elastic portion of the wearable support structure 118 and a plurality of back support staves 122. An activation mechanism system 114 senses accelerations and in response to a vertically downward component of acceleration exceeding a predetermined threshold for a predetermined period of time, the activation mechanism system 114 activates the inflators 112 to generate a volume of pressurized gas into the upper bladder 106 and lower bladder 108.

Figure 8:
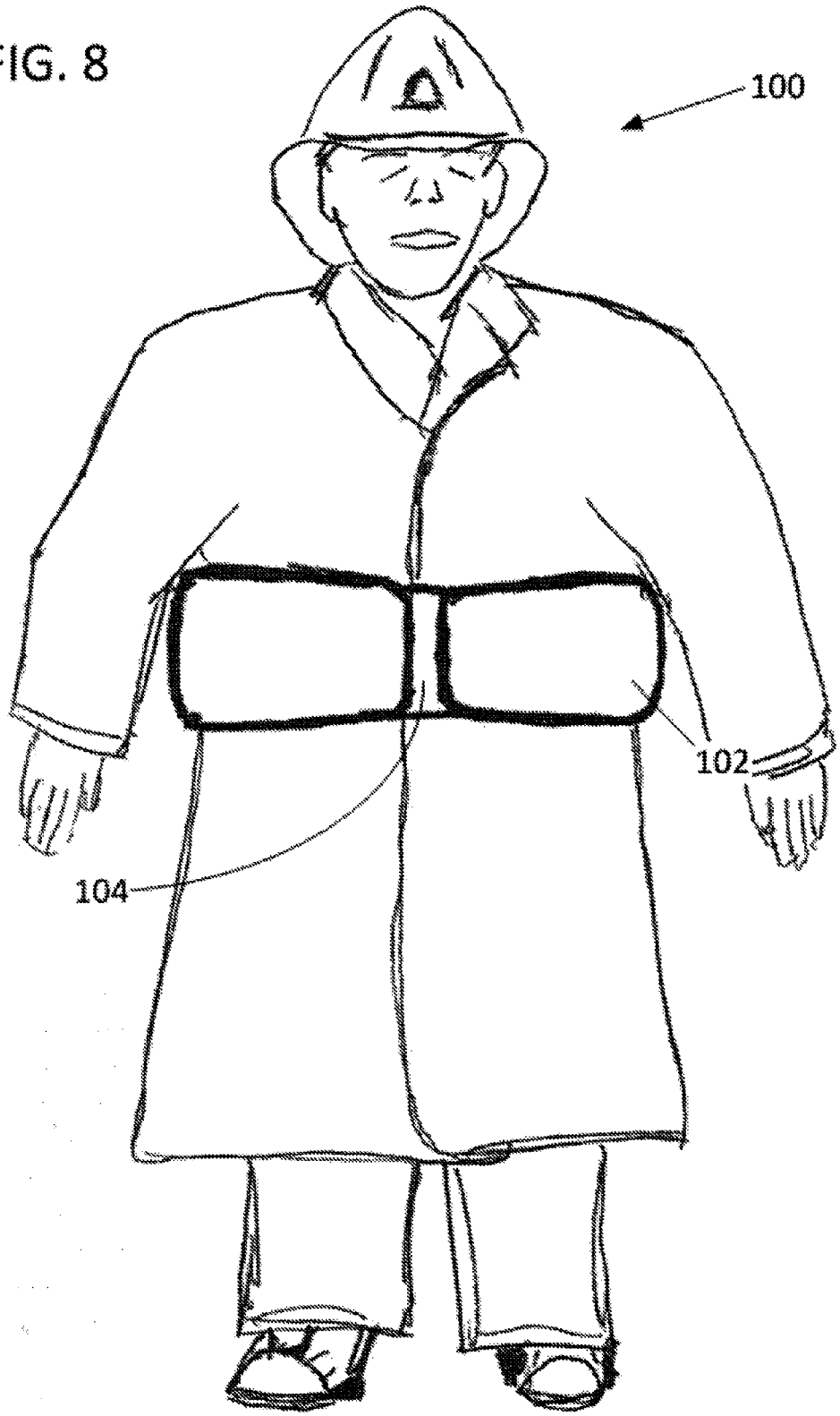
FIG. 8 depicts a front view of a firefighter wearing the inflatable fire protection apparatus in the uninflated condition.

FIG. 8 shows a wearer 100 wearing the personal protection apparatus 102, which may be associated with a wearable support structure 104 in the uninflated condition. The upper bladder 106 comprises a low-elasticity flexible material 116. A low-elasticity flexible material 116 may be Dacron, ballistic nylon, Kevlar, or another low-elasticity flexible material. The lower bladder 108 comprises a low-elasticity flexible material 116. A low-elasticity flexible material 116 may be Dacron, ballistic nylon, Kevlar, or another low-elasticity flexible material.

Figure 9:
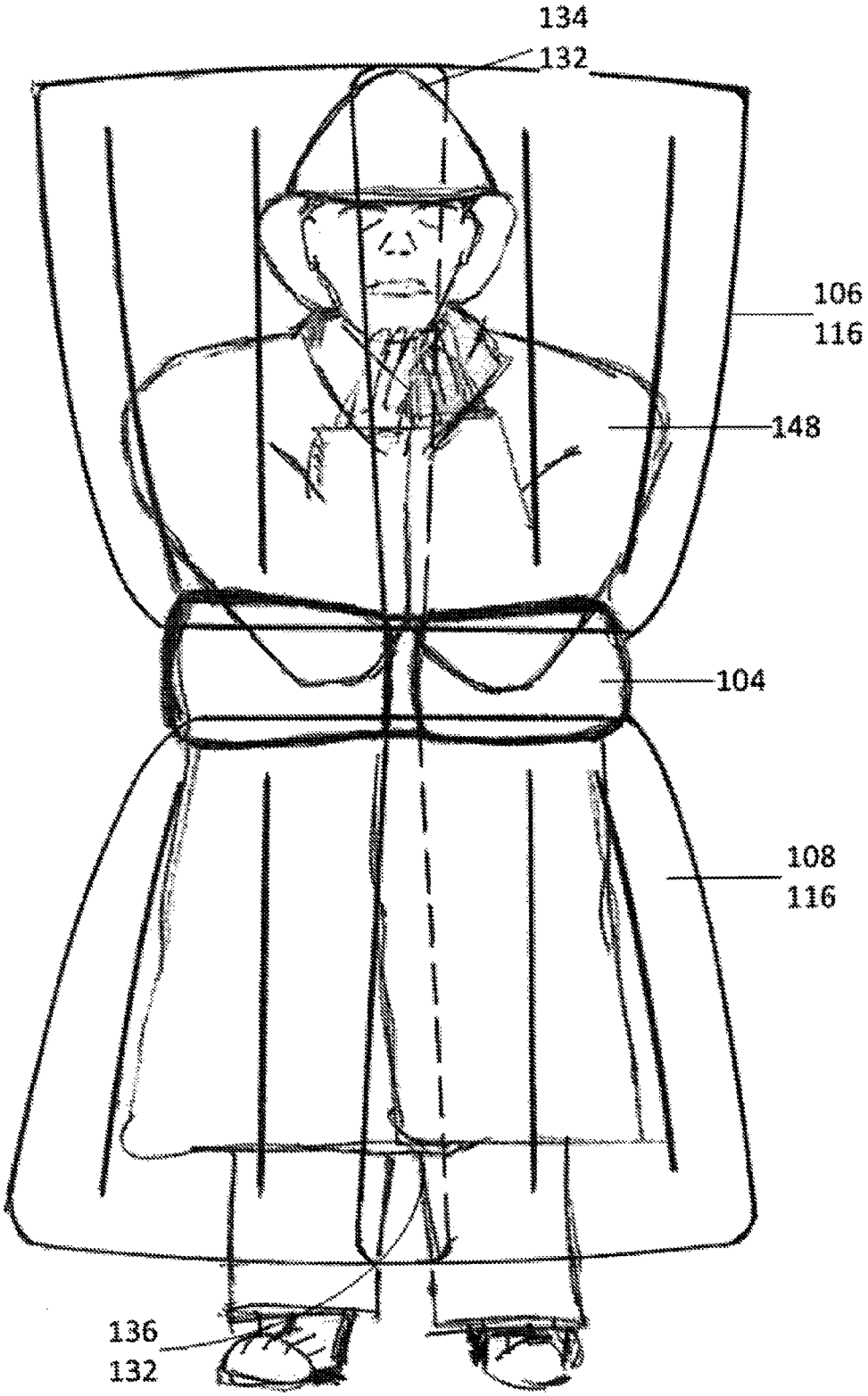
FIG. 9 depicts a front view of a firefighter wearing the inflatable fire protection apparatus in the inflated condition.

FIG. 9 shows a wearer 100 wearing the personal protection apparatus 102, which may be associated with a wearable support structure 104 in the inflated condition. The two ends 134 of the upper bladder form a discontinuous gap 132 and the two ends 136 of the upper bladder form also from a discontinuous gap 132. The upper bladders 106 and lower bladders 108 are comprised of interconnected chambers 148.

Figure 10:
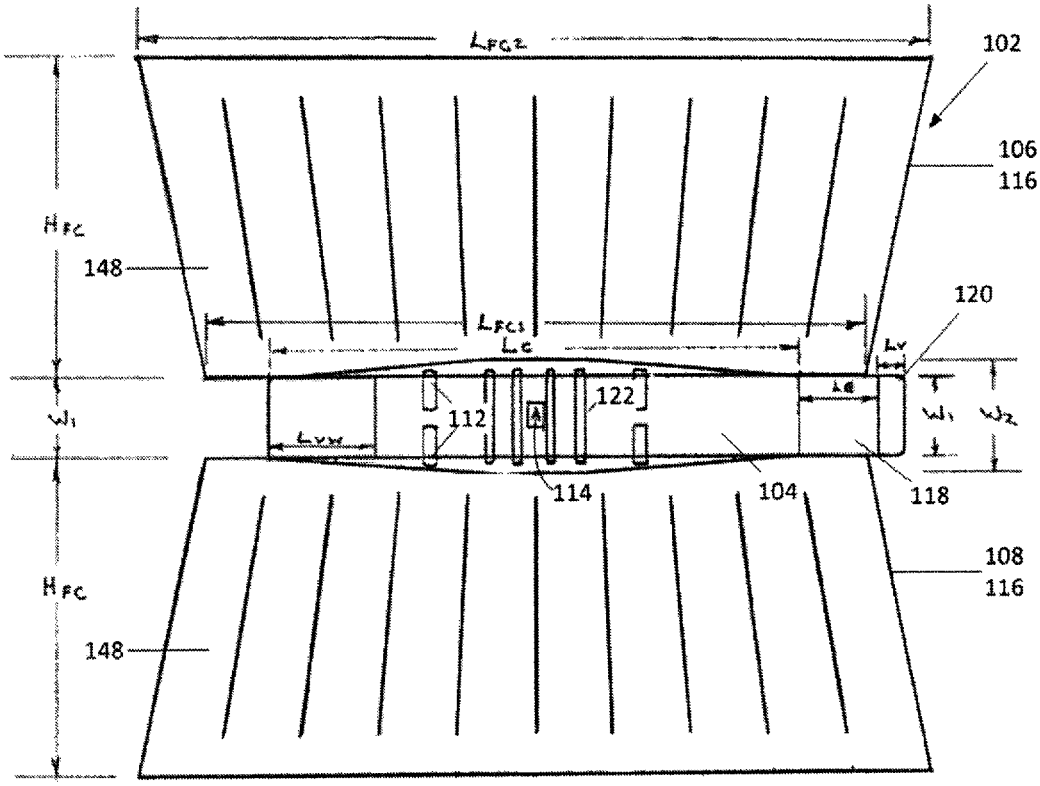
FIG. 10 depicts a configuration of the fire protection inflatable apparatus and associated wearable support structure and arrangement of its components.

FIG. 10 shows one embodiment of personal protection apparatus 102 with its upper bladder 106 and lower bladder 108. The personal protection apparatus 102 is associated with a wearable support structure 104 with a Velcro closer 120 and an elastic portion of the wearable support structure 118 and a plurality of back support staves 122. An activation mechanism system 114 senses accelerations and in response to a vertically downward component of acceleration exceeding a predetermined threshold for a predetermined period of time, the activation mechanism system 114 activates the inflators 112 to generate a volume of pressurized gas into the upper bladder 106 and lower bladder 108.

In some embodiments, The Security Cloud™ is a fall protection system designed to protect any person that is prone to slips, stumbles or falls while walking; or those for whom such a spill is likely to cause serious injury, like head injuries, broken bones, cuts, bruises or contusions. In some embodiments, The Security Cloud™ is a comfortable belt about 8 inches wide in the back and 6 inches wide in the front, contoured to be comfortable, which is worn over the clothes and is easy to put on and secure with an adjustable Velcro closure in the front. It is also easily taken off and can be used on an as needed basis, although you may find that wearing makes you feel better at the end of the day. The Security Cloud™ is fitted with flexible staves to support the lumbar spine improving posture for those who are seated for extended periods of time and reducing back fatigue for the wearer. The Security Cloud™ is light and fitted with an elastic section in the front of the belt, making it comfortable to wear even when moving and bending over. It has a streamlined design with outer covers that come in different colors and patterns to compliment your apparel.

In some embodiments, The Security Cloud™ uses an instantly inflated air bag cushion to protect the person wearing it from injuries resulting from stumbling or falling to the ground when walking or falling as you are climbing of descending stairs, by surrounding you instantly in an inflated Protective Cloud™ about four inches deep depending on the size, protecting you from your head to below the knees. Some embodiments are waterproof and can be worn in the shower providing security in one of the most dangerous places in the home, for those for whom a slip and fall could result in serious injury. The Security Cloud™ inflates as soon as a person begins to fall and is fully inflated, protecting the person in a Protective Cloud™ before they reach the floor. When any The Security Cloud™ fall protection device inflates it also activates a transponder that alerts a designated monitoring location of your location, where The Security Cloud™ has been activated. This may be a family member's cell phone or the local authorities or a dedicated security company according to the desires of the family. When inflated, the bladder has a predetermined shape being an hourglass shape having a first wide end, a second wide end, and a narrow portion, and wherein a predetermined position involves the narrow portion being arranged about the wearable support structure, and the first wide end and the second wide end being arranged on opposite sides of the narrow portion.

In some embodiments, The Security Cloud™ has an inflatable Protective Cloud™ built in to a belt. Associated with the belt are two inflatable bladders, an upper and a lower bladder, as illustrated in the figure on the previous page, that use air bag technology to surround the person in an inflated cushion to protect from injury as a result of the fall. The Bladders are made of a tough, light, material that is partitioned into 10 upper and 10 lower, vertical, interconnected chambers that inflate to surround the person in the event of a fall. It is this vertical, chambered configuration that causes the upper and lower bladders to surround the worker. The mechanism is similar to a segmented blow up pool float that is wrapped around the person with the segmented chambers in a vertical configuration. The figures below illustrate the concept. When inflated, the upper bladder has a first predetermined shape being a first conical shape having a first wide end and a first narrow end, and wherein a first predetermined position of the upper bladder involves the first narrow end being arranged about the wearable support structure and the first wide end being arranged above the wearable support structure, and wherein the lower bladder has a second predetermined shape being a second conical shape having a second wide end and a second narrow end, and wherein a second predetermined position of the lower bladder involves the second narrow end being arranged about the wearable support structure and the second wide end being arranged below the wearable support structure.

In some embodiments, The Security Cloud™ is worn over the clothes and comes in 4 belt sizes to accommodate nominal waist sizes from 30 inches to 50 inches. The Security Cloud™ has an adjustable belt made of a comfortable canvas fabric, 8" wide in the back ($W_2$), tapered to 6" in the front ($W_1$), with an outer cosmetic cover over the folded bladders ($L_C$), secured with 2 inches by 6 inches of Velcro ($L_V$), attaching to 8 or 10 inches (depending on the belt size) of Velcro wool ($L_{VW}$) for comfortable adjustment on the inside of the belt and with a 6 or 8 inch (depending on the belt size) elastic panel ($L_E$) for comfort and to allow the worker to comfortably bend over while wearing the belt.

Some embodiments are a small size with a belt length of 42 inches outer cover 34 inches long ($L_c$=34"), elastic 6 inches long ($L_E$=6") and Velcro 2 inches long ($L_V$=2") and with 8 inches of Velcro wool on the inside of the belt, for 30-34 inch nominal waists. Bladder horizontal lengths $L_{CH1}$=44"; $L_{CH2}$=54"

Some embodiments are a medium size with a belt length of 46 inches, outer cover 38 inches long ($L_c$=38"), elastic 6 inches long ($L_E$=6") and Velcro 2 inches long ($L_v$=2") and with 8 inches of Velcro wool on the inside of the belt, for 34-38 inch nominal waists. Bladder horizontal lengths $L_{CH1}$=48"; $L_{CH2}$=58"

Some embodiments are a large size with a belt length of 56 inches, outer cover 42 inches long ($L_c$=42"), elastic 8 inches long ($L_E$=8") and Velcro 2 inches long ($L_v$=2") and with 10 inches of Velcro wool on the inside of the belt, for 38-44 inch nominal waists. Bladder horizontal lengths $L_{CH1}$=52"; $L_{CH2}$=62".

Some embodiments are an extra-large size with a belt length of 58 inches, outer cover 48 inches long ($L_c$=48"), elastic 8 inches long ($L_E$=8") and Velcro 2 inches long ($L_v$=2") and with 10 inches of Velcro wool on the inside of the belt for 44-50 inch nominal waists. Bladder horizontal lengths $L_{CH1}$=58"; $L_{CH2}$=68"

In some embodiments, The Security Cloud™ uses the same technology that is built into Cloud safety Systems™ industrial fall prevention and fall protection devices The Safety Cloud™ and The Cloud Harness™.

In some embodiments, the horizontal length of the bladders ($L_{CH1}$, $L_{CH2}$) terminates in two ends for each the upper and lower bladders. The mid point is defined as half way between these ends and is located at the center of the back when the harness is worn. When The Security Cloud™ is inflated these ends extend beyond the belt length, causing an overlap at the front when the bladders inflate. This is designed to ensure that there is not an unprotected gap at the front of The Security Cloud™ in the inflated condition.

In some embodiments, inflation is provided by 4 individual, electronically activated, inflators, two inflating the upper segmented bladder and two inflating the lower segmented bladder, each of the inflators is attached to the belt and the un-inflated bladders are folded onto the belt over the inflators in a specific (origami style) pattern to ensure reliable deployment on inflation. The folded bladders are held in place by a light film of adhesive. The upper and lower segmented bladders are a proprietary design with the inflators located to initiate inflation at the rear of the belt symmetrically around the defined midpoint of the upper and lower bladders and progressing toward the overlapping ends of the bladders at the front of the belt via the circuitous route of the chambers. The inflation therefore progresses from the back to the front of The Security Cloud™. This is designed to ergonomically move the wearers arms forward during the inflation of The Cloud Harness™.

In some embodiments, the activation mechanism system includes a directional accelerometer, electrical connections to each of the 4 inflators, a transponder to communicate your location when The Security Cloud™ is activated and a battery to power the system. The activation mechanism system is programmed to generate specifically sequenced electronic signals, triggered by exceeding threshold values of acceleration for a period of time designed and programmed to activate the inflators, to provide protection from injury during the fall. The accelerometer is located in the center of the back of the belt, at the small of the person's back, at the approximate center of gravity of a person. The trigger mechanism is oriented by gravity and programmed with a threshold chosen to prevent unintended deployment. The activation mechanism system is programmed for a threshold of motion to the approximate center of gravity of the worker (small of the back), of downward acceleration greater than 20 ft/second$^2$ for approx 7 inches traveled. This threshold initiates the inflation of the four inflators, to inflate the upper and lower bladders of The Security Cloud™ simultaneously. The Security Cloud™ will inflate and encircle the person, in a manner illustrated in the preceding figures. As The Security Cloud™ envelops the person, there is an overlap at the front to ensure full protection by the inflated cushion and allow breathing to be unimpeded as the air bag cushion protects the person. When inflated The Security Cloud™ cushions the person from impact any obstructions struck during a fall, reducing the chance of and severity of injuries. The bladders remain inflated, ensuring that the person is safely supported for about 5 minutes, allowing the person to get up and or wait for assistance to arrive. Inflation begins at the threshold point and inflation time is designed to result in total inflation being completed before the person has fallen more that 12 inches inches, providing the Protective Cloud™ during the fall.

In some embodiments, The Cloud Harness™ is a fall protection device designed to protect workers from potentially harmful structure during a fall that is arrested by a harness, and lanyard style fall arrest system. For elevated work areas that do not have regular gaps or spaces less that about 36 inches or are not surrounded by a railing system, The Cloud Harness™ provides improved fall protection, by its instant inflating cushion, built into a comfortable harness and traditional lanyard.

In some embodiments, if a work site has gaps larger than 36", or in high rise construction or steel erection in industrial plants, where gaps in structure are not regular or are not contained by a railing system, The Cloud Harness™ will provide protective cushioning in the event of a fall. Although the lanyard attached to a fixed point, applies a horizontal component to the restraining force, that tends to pull the worker toward the structure, The Cloud Harness™ will provide cushioning from structural members, minimizing injury when a worker is restrained by a shock absorbing lanyard.

In some embodiments, The Cloud Harness™ is the choice for working in areas that have gaps larger than 36 inches or that cannot be surrounded by a railing system. Workers are provided with instant cushioning from the risks associated with a tethered fall arrest system. The air bag style cushion deploys when a worker begins to fall, cushioning the worker from direct contact with structure, protecting the worker from broken bones, lacerations and bruises while the fall arresting lanyard stops the fall.

In some embodiments, The Cloud Harness™ has an inflatable Protective Cloud™ built in to a belt that is integrated into a fall protection harness. Associated with the belt are two inflatable bladders, an upper and a lower bladder that use air bag technology to surround the worker in an inflated cushion while the harness and lanyard arrest a fall. The Bladders are made of a tough, puncture resistant material that is partitioned into 10 upper and 10 lower, vertical, interconnected chambers that inflate to surround the worker in the event of a fall. It is this vertical, chambered configuration that causes the upper and lower bladders to surround the worker. The mechanism is similar to a segmented blow up pool float that is wrapped around the worker with the segmented chambers in a vertical configuration.

In some embodiments, The Cloud Harness™ is worn over the work clothes and comes in 4 belt sizes to accommodate nominal waist sizes from 30 inches to 50 inches. The belt is comfortably integrated in to a heavy duty fall arrest harness. The Cloud Harness™ has an adjustable belt made of a comfortable canvas fabric, 8½" wide in the back ($W_2$), tapered to 6" in the front ($W_1$), with an outer cosmetic cover over the folded bladders ($L_C$), secured with 3 inches by 6 inches of Velcro ($L_v$), attaching to 8 or 10 inches (depending on the belt size) of Velcro wool ($L_{VW}$) for comfortable adjustment on the inside of the belt and with a 5 or 7 inch (depending on the belt size) elastic panel ($L_E$) for comfort and to allow the worker to comfortably bend over while wearing the belt.

Some embodiments are a small size with a belt length of 42 inches outer cover 34 inches long ($L_c$=34"), elastic 5 inches long ($L_E$=5") and Velcro 3 inches long ($L_v$=3") and with 8 inches of Velcro wool on the inside of the belt, for 30-34 inch nominal waists. Bladder horizontal lengths $L_{CH1}$=44"; $L_{CH2}$=54"

Some embodiments are a medium size with a belt length of 46 inches, outer cover 38 inches long ($L_c$=38"), elastic 5 inches long ($L_E$=5") and Velcro 3 inches long ($L_v$=3") and with 8 inches of Velcro wool on the inside of the belt, for 34-38 inch nominal waists. Bladder horizontal lengths $L_{CH1}$=48"; $L_{CH2}$=58"

Some embodiments are a large size with a belt length of 56 inches, outer cover 42 inches long ($L_c$=42"), elastic 7 inches long ($L_E$=7") and Velcro 3 inches long ($L_v$=3") and with 10 inches of Velcro wool on the inside of the belt, for 38-44 inch nominal waists. Bladder horizontal lengths $L_{CH1}$=52"; $L_{CH2}$=62"

Some embodiments are an extra large size with a belt length of 58 inches, outer cover 48 inches long ($L_c$=48"), elastic 7 inches long ($L_E$=7") and Velcro 3 inches long ($L_v$=3") and with 10 inches of Velcro wool on the inside of the belt for 44-50 inch nominal waists. Bladder horizontal lengths $L_{CH1}$=58"; $L_{CH2}$=68"

In some embodiments, four staves are built into the back of the belt to support the lumbar spine, relieving stress on the lower back, similar to the back braces worn by workers when heavy lifting is part of their job (like those at Home depot, lumber yards and Lowes). Wearing The Cloud Harness™ during the working day results in less back fatigue, leaving workers more refreshed after a days work while helping to avoid back injuries that could prevent the workers from doing their jobs.

In some embodiments, The Cloud Harness™ uses the same technology found in The Safety Cloud™ fall prevention system to inflate a Protective Cloud™ around the worker as the fall arrest lanyard stops a fall.

In some embodiments, the horizontal length of the bladders ($L_{CH1}$, $L_{CH2}$) terminates in two ends for each the upper and lower bladders. The mid point is defined as half way between these ends and is located at the center of the back when the harness is worn. When The Cloud Harness™ is inflated these ends extend beyond the belt length, causing an overlap at the front when the bladders inflate. This is designed to ensure that there is not an unprotected gap at the front of The Cloud Harness™ in the inflated condition.

In some embodiments, inflation is provided by 4 individual, electronically activated, inflators, two inflating the upper segmented bladder and two inflating the lower segmented bladder, each of the inflators is attached to the belt and the un-inflated bladders are folded onto the belt over the inflators in a specific (origami style) pattern to ensure reliable deployment on inflation. The folded bladders are held in place by a light film of adhesive. The upper and lower segmented bladders are a proprietary design with the inflators located to initiate inflation at the rear of the belt symmetrically around the defined midpoint of the upper and lower bladders and progressing toward the overlapping ends of the bladders at the front of the harness via the circuitous route of the chambers. The inflation therefore progresses from the back to the front of The Cloud Harness™. This is designed to ergonomically move the wearers arms forward during the inflation of The Cloud Harness™.

In some embodiments, the activation mechanism system includes a directional accelerometer, electrical connections to each of the 4 inflators, a transponder to communicate your location when The Cloud Harness™ is activated and a battery to power the system. The activation mechanism system is programmed to generate specifically sequenced electronic signals, triggered by exceeding threshold values of acceleration for a period of time designed and programmed to activate the inflators, to provide protection from injury during the arrest of a fall by the harness and fall arresting lanyard. The accelerometer is located in the center of the back of the belt, at the small of the worker's back, at the approximate center of gravity of a person. The trigger mechanism is oriented by gravity and programmed with a threshold chosen to prevent unintended deployment. The activation mechanism system is programmed for a threshold of motion to the approximate center of gravity of the worker (small of the back), of downward acceleration greater than 30 ft/second$^2$ for approx 24 inches traveled. This threshold initiates the inflation of the four inflators, to inflate to inflate the upper and lower bladders of The Cloud Harness™ simultaneously. The Cloud Harness™ will inflate and encircle the worker, in a manner illustrated in the preceding figures. As The Cloud Harness™ envelops the worker, there is an overlap at the front to ensure full protection by the inflated cushion and allow breathing to be unimpeded as the air bag cushion protects the worker. When inflated The Cloud Harness™ cushions the worker from impact with structural items, reducing the chance of and severity of injuries. The bladders remain inflated, ensuring that the worker is safely supported for as long as it takes for assistance to arrive to get him up and on his feet again. Inflation begins at the threshold point and inflation time is designed to result in total inflation being completed before the worker has fallen more that 30 inches, providing the Protective Cloud™ during the 6 foot fall required for the lanyard to arrest the fall.

The traditional harness only stops the descent of a falling worker after the lanyard reaches its full length, becomes taught, and has extended 6 additional feet to arrest the fall. It does not provide protection from contact with the structure. This allows the worker's entire body and head to pass through the structure unprotected, while the lanyard's arresting force is pulling the worker dangerously toward and against structures that cause injuries in most cases.

Some embodiments of the personal protection system are for work sites that don't have regular gap of less than 36" or are nor able to be surrounded by a railing system or walls.

In some embodiments, The Fire Cloud™ is a radiant heat & temperature protection system designed to improve protection of fire fighters from exposure to harmful levels of radiant heat and temperature that may develop instantaneously, before a fire fighter has a chance to react. The Fire Cloud™ uses air bag technology to instantly inflate additional insulation and reflective protection, when thresholds of temperature or radiation are exceeded. This is envisioned as additional protection that would deploy automatically if a fire fighter were caught in a backdraft, where conditions provide fresh oxygen to a fire causing it to explode back at fire fighter in a flash or other swiftly developing situations that a fire fighter would not be able to react to in time. The added protection would afford the fire fighter additional moments to escape in such an emergency situation and could reduce associated injuries or possibly prevent death.

In some embodiments, The Fire Cloud™ is a belt about 9 inches wide in the back and 7 inches wide in the front, which is worn over the fire fighters existing fire gear, secured with an adjustable Velcro closure in the front. The belt supports upper and lower inflatable bladders that inflate instantaneously, surrounding the fire fighter instantly in an inflated Protective Cloud™ protecting him from his head to below the knees. The Fire Cloud™ is made of translucent, fire resistant, flexible material with reflective properties on one side of the material. When inflated these bladders have the properties of a one way mirror, reflecting radiant heat while the fire fighter can see through it and it creates a 4"-5" air space that extends the time that a fire fighter can survive exposure to intense heat.

In some embodiments, the personal protection apparatus is an addition, to be worn externally to existing fire gear. The personal protection apparatus may be incorporated into the inside of the fire fighters protective fireproof coat, using the envisioned activation mechanism system to inflate the 4"-5" of insulating air space to the inside of the fireproof coat, with an extension coming out of the collar to protect the head and from the bottom hem of the fireproof coat to provide additional protection the lower extremities in the instantaneously developing emergency situation of a backdraft or similar emergency. This envisioned integration into the fireproof coat would take full advantage of the existing design properties of the fireproof coat and would deploy more reliably than the externally worn belt. It would also perform better if SCBA is being worn outside of the fireproof coat by the fire fighter and the external inflatable bladders would have to inflate around the SCBA.

In some embodiments, The Fire Cloud™ uses an instantly inflated air bag, triggered by threshold levels of temperature and radiation, to provide thermal insulation and to reflect radiant energy away from the fire fighter wearing it. This instantaneous, additional protection extends the period of time that a fire fighter can survive being exposed to excessive heat and temperature, protecting him from associated injuries. When The Fire Cloud™ fire protection device inflates it also activates a transponder that alerts a designated monitoring location of the firefighters location, where The Fire Cloud™ has been activated. This may provide timely information for his fellow first responders, who could initiate rescue action in time to mount a successful rescue operation.

In some embodiments, The Fire Cloud™ uses technology to provide fire fighters with automatic protection in a time frame much faster that human reaction. The Fire Cloud™ senses a threat and deploys protection in time to provide a chance for the fire fighter to escape and for stand-by first responders to initiate timely rescue efforts.

In some embodiments, The Fire Cloud™ has an inflatable Protective Cloud™ built in to a belt. Associated with the belt are two inflatable bladders, an upper and a lower bladder, as illustrated in the figure on the previous page, that use air bag technology to surround the person in an inflated shield, to protect from extreme temperature or radiation. The Bladders are made of a translucent, fireproof, reflective material that is partitioned into 10 upper and 10 lower, vertical, interconnected chambers that inflate to surround the fire fighter in the event that threshold levels of temperature or heat radiation are exceeded. It is this vertical, chambered configuration that causes the upper and lower bladders to surround the fire fighter.

In some embodiments, The Fire Cloud™ is worn over the fireproof coat worn by firefighters and comes in 3 belt sizes to accommodate nominal waist sizes from 30 inches to 44 inches. The Fire Cloud™ has an adjustable belt made of fire resistant fabric, 9" wide in the back ($W_2$), tapered to 7" in the front ($W_1$), with an outer cosmetic cover over the folded bladders ($L_C$), secured with 4 inches by 7 inches of Velcro ($L_v$), attaching to 8 or 10 inches (depending on the belt size) of Velcro wool ($L_{VW}$) for easy adjustment on the inside of the belt and with a 4 or 6 inch (depending on the belt size) elastic panel ($L_E$) to allow the fire fighter to bend over while wearing the belt. The vertical extent of the upper and lower bladders is 30 inches ($H_{FC}$=30")

Some embodiments are a medium size with a belt length of 50 inches, outer cover 42 inches long ($L_c$=42"), elastic 4 inches long ($L_E$=4") and Velcro 4 inches long ($L_v$=4") and with 8 inches of Velcro wool on the inside of the belt. Bladder horizontal lengths $L_{FC1}$=52"; $L_{FC2}$=62"

Some embodiments are a large size with a belt length of 58 inches, outer cover 48 inches long ($L_c$=48"), elastic 6 inches long ($L_E$=6") and Velcro 4 inches long ($L_v$=4") and with 10 inches of Velcro wool on the inside of the belt. Bladder horizontal lengths $L_{FC1}$=58"; $L_{FC2}$=68"

Some embodiments are an extra large size with a belt length of 64 inches, outer cover 54 inches long ($L_c$=54"), elastic 6 inches long ($L_E$=6") and Velcro 4 inches long ($L_v$=4") and with 10 inches of Velcro wool on the inside of the belt. Bladder horizontal lengths $L_{FC1}$=64"; $L_{FC2}$=74"

In some embodiments, the horizontal length of the bladders ($L_{FC1}$, $L_{FC2}$) terminates in two ends for each the upper and lower bladders. The mid point is defined as half way between these ends and is located at the center of the back when the belt is worn. When The Fire Cloud™ is inflated these ends extend beyond the belt length, causing an overlap at the front when the bladders inflate. This is designed to ensure that there is not an unprotected gap at the front of The Fire Cloud™ in the inflated condition.

In some embodiments, inflation is provided by 4 individual, electronically activated, inflators, two inflating the upper segmented bladder and two inflating the lower segmented bladder, each of the inflators is attached to the belt and the un-inflated bladders are folded onto the belt over the inflators in a specific (origami style) pattern to ensure reliable deployment on inflation. The folded bladders are held in place by a light film or adhesive. The upper and lower segmented bladders are a proprietary design with the inflators located to initiate inflation at the rear of the belt symmetrically around the defined midpoint of the upper and lower bladders and progressing toward the overlapping ends of the bladders at the front of the belt via the circuitous route of the chambers. The inflation therefore progresses from the back to the front of The Fire Cloud™. This is designed to ergonomically move the fire fighter's arms forward during the inflation of The Fire Cloud™.

In some embodiments, the activation mechanism system includes two temperature sensors and two thermal radiation sensors, electrical connections to each of the 4 inflators, a transponder to communicate your location when The Fire Cloud™ is activated and a battery to power the system. The activation mechanism system is programmed to generate specifically sequenced electronic signals, triggered by exceeding threshold values of temperature or radiation and is programmed to activate the inflators, to provide protection for the fire fighter. The heat sensors and radiation sensors are located in the front and back of the belt to assure detection. The trigger mechanism is programmed with thresholds chosen to prevent unintended deployment. The threshold immediately initiates the inflation of the four inflators, to inflate the upper and lower bladders of The Fire Cloud™ simultaneously. The Fire Cloud™ will inflate and encircle the fire fighter, in a manner illustrated in the preceding figures. As The Fire Cloud™ envelops the fire fighter, there is an overlap at the front to ensure full protection by the inflated insulation and reflective properties as the air bag insulates the fire fighter. The bladders remain inflated, ensuring that the fire fighter is safely protected, allowing the fire fighter additional time to escape. Inflation begins at the threshold point and inflation time is designed to result in total inflation being completed in 30 milliseconds.

In some embodiments, the H2S Protector™ is an device for providing the wearer with an over pressured supply of fresh air inside of and instantaneously inflated hood that deploys when H2S concentrations are detected above at least 50 PPM. The H2S Protector™ includes a continuous gas monitor that is set to activate an inflation mechanism system that inflates a specially designed hood that covers the entire head and is supplied with a regulated air supply, discharging breathing air inside the hood, which is enclosing the head.

In some embodiments, the inflatable hood is made of a transparent, low elasticity material that is flexible. The transparent inflated hood is fitted with a portion in front of the eyes that the wearer can see through to be able to escape. This provides the wearer with instantaneous protection for the toxic effect of H2S exposure, immediately upon detection of a hazardous atmosphere. The air supply provides 10 minutes of escape air for the wearer.

In some embodiments, the Asbestos Protector™ is a device for providing the wearer with an over pressured supply of fresh air inside of and instantaneously inflated hood that deploys when asbestos particulate concentrations are detected above the OSHA threshold. The Asbestos Protector™ includes a continuous particulate concentration monitor that is set to activate an inflation mechanism system that inflates a specially designed hood that covers the entire head and is supplied with a regulated air supply, discharging breathing air inside the hood, which is enclosing the head.

In some embodiments, the inflatable hood is made of a transparent, low elasticity material that is flexible. The transparent inflated hood is fitted with a portion in front of the eyes that the wearer can see through to be able to escape. This provides the wearer with instantaneous protection for the toxic effect of asbestos exposure, immediately upon detection of a hazardous atmosphere. The air supply provides 10 minutes of escape air for the wearer.

In some embodiments, the apparatus is attached via the foundation, straps, hooks or otherwise to an object rather than a user to protect the object.

While the disclosed subject matter has been described with respect to a limited number of embodiments, the specific features of one embodiment should not be attributed to other embodiments of the disclosed subject matter. No single embodiment is representative of all aspects of the disclosed subject matter. Moreover, variations and modifications therefrom exist. For example, the disclosed subject matter described herein may comprise other components. Various additives may also be used to further enhance one or more properties. In some embodiments, the disclosed subject matter is substantially free of any additive not specifically enumerated herein. Some embodiments of the disclosed subject matter described herein consist of or consist essentially of the enumerated components. In addition, some embodiments of the methods described herein consist of or consist essentially of the enumerated steps. The claims to be appended later intend to cover all such variations and modifications as falling within the scope of the disclosed subject matter.

What is claimed is:

1. A personal protection apparatus for preventing or substantially reducing injury to a wearer of said apparatus experiencing a fall or similar event, said personal protection apparatus comprising:

a wearable support structure comprising an elongate belt having two ends configured to be releasably securable about the waist of a wearer; and an inflatable apparatus, wherein said inflatable apparatus attaches to said elongate belt, whereby said elongate belt supports said inflatable apparatus, said inflatable apparatus comprises:

a bladder having a first end attached at a first end of said elongate belt and a second end attached at a second end of said elongate belt, said bladder configured to receive a volume of pressurized gas and inflatable to a substantially fixed volume, said bladder comprising a low-elasticity flexible material having a plurality of interconnected segments, wherein said plurality of interconnected segments enable said bladder to take on a predetermined shape, a predetermined position, or some combination thereof upon inflation to said substantially fixed volume, and wherein said predetermined shape of said bladder comprises a breathing gap for allowing the wearer to breathe when said bladder is inflated to said substantially fixed volume, and wherein when inflated to said substantially fixed volume, said first end of said bladder extends past said first end of said elongate belt and said second end of said bladder extends past said second end of said elongate belt, whereby said first end of said bladder and said second end of said bladder overlap when inflated to said substantially fixed volume;

at least one inflator connected to said bladder, said at least one inflator configured to inflate said bladder with a volume of pressurized gas, and an activation system configured to detect aspects of motion, wherein in response to a detection of one or more aspects of motion exceeding a predetermined threshold for a predetermined period of time, said activation system enables said at least one inflator to transfer a volume of pressurized gas from said at least one inflator to said bladder, thereby causing said bladder to inflate to said substantially fixed volume.

2. The personal protection apparatus of claim 1, wherein said activation system comprises:

an accelerometer configured to detect aspects of motion;

a processor configured to evaluate said aspects of motion;

a transponder for communicating the position of said inflatable apparatus;

a portable power source configured to provide power to said personal protection apparatus; and an electrical connection between said accelerometer, said processor, said transponder, said portable power source, said at least one inflator, or some combination thereof, wherein said electrical connection is configured to enable activation of said at least one inflator, said electrical connection further configured to enable activation of said transponder.

3. The personal protection apparatus of claim 1, wherein said inflatable apparatus further comprises at least one additional bladder, and wherein said at least one inflator is further configured to transfer a volume of pressurized gas into one or more of said at least one additional bladder.

4. The personal protection apparatus of claim 1, wherein said pressurized gas is sealed inside of said inner bladder after inflation.

5. The personal protection apparatus of claim 1, wherein said inflatable apparatus transitions from an un-inflated state and one or more of a rolled condition and a folded condition, to an inflated state and one or more of an unrolled condition and an unfolded condition in response to being inflated to said substantially fixed volume.

6. The personal protection apparatus of claim 1, further comprising a breakaway outer layer, wherein said breakaway outer layer covers at least a portion of said bladder when said bladder is configured in an un-inflated state and one or more of a rolled or folded condition.

7. The personal protection apparatus of claim 1, wherein said pressurized gas is sealed inside of said bladder after inflation.

8. The personal protection apparatus of claim 1, wherein the wearable support structure further comprises:

an elastic portion configured to flex in response to the movement of the wearer; and a plurality of back support staves configured to provide lumbar support;

and wherein said wearable support structure and said inflatable apparatus are one or more of contoured and arranged to provide the wearer with unobstructed freedom of movement.

9. The personal protection apparatus of claim 1, wherein said at least one inflator comprises one or more inflators selected from the group consisting of:

a compressed-gas inflator;

an inflator comprising a plurality of compounds, wherein, when mixed, said plurality of compounds generates gas; and a solid-propellant inflator.

10. The personal protection apparatus of claim 1, wherein said plurality of interconnected segments are configured to inflate symmetrically starting at a midpoint of the bladder and continuing progressively and sequentially from the midpoint of the bladder through the plurality of interconnected segments until the bladder reaches said predetermined shape at said substantially fixed volume, and configured to move the limbs of the wearer forward in an ergonomic manner as said bladder is inflated to said substantially fixed volume.

11. The personal protection apparatus of claim 1, wherein once said bladder is inflated to said substantially fixed volume increased pressure does not substantially increase said substantially fixed volume of said bladder until a yield point of said low-elasticity flexible material is reached.

12. The personal protection apparatus of claim 1, wherein said predetermined shape comprises a hourglass shape comprising a first wide end, a second wide end, and a narrow portion, and wherein said predetermined position comprises said narrow portion being arranged about said wearable support structure, and said first wide end and said second wide end being arranged on opposite sides of said narrow portion.

13. A personal protection apparatus for preventing or substantially reducing injury to a wearer of said apparatus experiencing a fall or similar event, said personal protection apparatus comprising:

a wearable support structure comprising an elongate belt having two ends configured to be releasably_securable about the waist of a wearer; and an inflatable apparatus, wherein said inflatable apparatus is attached to and supported by said elongate belt, and wherein said inflatable apparatus comprises:

an upper bladder having a first end attached at a first end of said elongate belt and a second end attached at a second end of said elongate belt, said upper bladder configured to receive a volume of pressurized gas and inflatable to a substantially fixed volume, said upper bladder comprising a low-elasticity flexible material having a first plurality of interconnected segments, wherein said first plurality of interconnected segments enable said upper bladder to take on a first predetermined shape upon inflation of said upper bladder to said substantially fixed volume said first predetermined shape configured to encircle the wearer when inflated to said substantially fixed volume, and wherein said first predetermined shape of said upper bladder comprises a breathing gap for allowing the wearer to breathe when said upper bladder is inflated to said substantially fixed volume, and wherein when inflated to said substantially fixed volume, said first end of said upper bladder extends past said first end of said elongate belt and said second end of said upper bladder extends past said second end of said elongate belt, whereby said first end of said upper bladder and said second end of said upper bladder overlap when inflated to said substantially fixed volume;

a lower bladder having a first end attached at the first end of said elongate belt and a second end attached at the second end of said elongate belt, said lower bladder configured to receive a volume of pressurized gas and inflatable to a substantially fixed volume, said lower bladder comprising a low-elasticity flexible material having a second plurality of interconnected segments, wherein said second plurality of interconnected segments enable said lower bladder to take on a second predetermined shape upon inflation of said lower bladder to said substantially fixed volume, said second predetermined shape configured to encircle the wearer when inflated to said substantially fixed volume, and wherein when inflated to said substantially fixed volume, said first end of said lower bladder extends past said first end of said elongate belt and said second end of said lower bladder extends past said second end of said elongate belt, whereby said first end of said lower bladder and said second end of said lower bladder overlap when inflated to said substantially fixed volume;

at least one inflator connected to said upper bladder, said lower bladder, or both, said at least one inflator configured to enable inflation of said upper bladder, said lower bladder, or both with a volume of pressurized gas; and an activation system configured to detect aspects of motion, wherein in response to a detection of one or more aspects of motion exceeding a predetermined threshold for a predetermined period of time, said activation system initiates an inflation sequence comprising:

activating said at least one inflator;

transferring a volume of pressurized gas into said upper bladder, said lower bladder, or both; and inflating respective said substantially fixed volumes of said upper bladder, said lower bladder, or both.

14. The personal protection apparatus of claim 13, wherein said activation system comprises:

an accelerometer configured to detect aspects of motion;

a processor for evaluating said aspects of motion;

for communicating the position of said inflatable apparatus; and a portable power source for providing power to the personal protection apparatus; and an electrical connection between said accelerometer, said processor, said transponder, said portable power source, said at least one inflator, or some combination thereof, wherein said electrical connection enables activation of said inflation sequence, said electrical connection further configured to enable activation of said transponder.

15. The personal protection apparatus of claim 13, wherein said inflatable apparatus transitions from an un-inflated state and one or more of a rolled condition and a folded condition, to an inflated state and one or more of an unrolled condition and an unfolded condition in response to being inflated to said substantially fixed volume.

16. The personal protection apparatus of claim 13, further comprising a breakaway outer layer, wherein said breakaway outer layer covers at least a portion of said upper bladder, at least a portion of said lower bladder, or a combination thereof when said upper bladder and said lower bladder are in an un-inflated state and one or more of a rolled condition and a folded condition.

17. The personal protection apparatus of claim 13, wherein once said upper bladder and said lower bladder are inflated to said substantially fixed volumes increased pressure does not substantially increase said substantially fixed volumes of said upper bladder and said lower bladder until a yield point of said low-elasticity flexible material is reached.

18. The personal protection apparatus of claim 13, wherein the wearable support structure further comprises:

an elastic portion configured to flex in response to the movement of the wearer; and a plurality of back support staves configured to provide lumbar support;

and wherein said wearable support structure and said inflatable apparatus are one or more of contoured and arranged to provide the wearer with unobstructed freedom of movement.

19. The personal protection apparatus of claim 13, wherein said wearable support structure further comprises a fall arrest harness, said fall arrest harness comprising:

one or more shoulder straps, one or more crotch straps, or a combination thereof; and a lanyard attachment point configured to engage with a safety lanyard attached at one end to an anchor point.

20. The personal protection apparatus of claim 13, wherein said low-elasticity flexible material of said upper bladder, said lower bladder, or some combination thereof is puncture-resistant.

21. The personal protection apparatus of claim 13, wherein the first plurality of interconnected segments of said upper bladder are configured to inflate symmetrically starting at a midpoint of the upper bladder and continuing progressively and sequentially from the midpoint of the upper bladder through the first plurality of interconnected segments until the upper bladder reaches said first predetermined shape at said substantially fixed volume, said second plurality of interconnected segments of said lower bladder are configured to inflate symmetrically starting at a midpoint of the lower bladder and continuing progressively and sequentially from the midpoint of the lower bladder through the second plurality of interconnected segments until the lower bladder reaches said second predetermined shape at said substantially fixed volume, or both and configured to move the limbs of the wearer forward in an ergonomic manner as said upper bladder, said lower bladder, or both are is inflated to said substantially fixed volume.

22. The personal protection apparatus of claim 13, wherein said first predetermined shape of said upper bladder comprises a first conical shape comprising a first wide end and a first narrow end, and wherein said first predetermined position of said upper bladder comprises said first narrow end being arranged about said wearable support structure and said first wide end being arranged above said wearable support structure, and wherein said second predetermined shape of said lower bladder comprises a second conical shape comprising a second wide end and a second narrow end, and wherein said second predetermined position of said lower bladder comprises said second narrow end being arranged about said wearable support structure and said second wide end being arranged below said wearable support structure.

23. The personal protection apparatus of claim 13, wherein said at least one inflator comprises one or more inflators selected from the group consisting of:

a compressed-gas inflator;

an inflator comprising a plurality of compounds, wherein, when mixed, said plurality of compounds generates gas; and a solid-propellant inflator.

* * * * *